United States Patent [19]

Kuo

[11] Patent Number: 4,691,391

[45] Date of Patent: Sep. 8, 1987

[54] TOILET HAVING WIRE-ADJUSTED WATER-SPRAY NOZZLES

[76] Inventor: Dai-Ming Kuo, P.O. Box 10160, Taipei, Taiwan

[21] Appl. No.: 872,146

[22] Filed: Jun. 9, 1986

[51] Int. Cl.[4] ..... E03D 9/08

[52] U.S. Cl. ..... 4/447; 4/420.4

[58] Field of Search ..... 4/420.1–420.5, 4/443–448

[56] References Cited

U.S. PATENT DOCUMENTS 2,104,271 1/1938 Parisini ..... 4/447 X 3,425,066 2/1969 Berger ..... 4/420.4

4,094,018 6/1978 Bemthin ..... 4/420.4

*Primary Examiner*—Charles E. Phillips

[57] ABSTRACT

A toilet includes a warm water source, two valves controlling two branch water conduits directing water from the water source, a rear-side nozzle, a front-side nozzle, and two spraying-angle adjusters, of which each spraying-angle adjuster includes a rack engaged with a driving gear, a wire connected between the rack and a nozzle, and a flexible hose jacketing the wire, whereby upon the rotation of the driving gear, the rack and the wire will be pushed or retracted to bias the nozzle to adjust the water-spraying angle for thoroughly cleaning the anus or genitals of the toilet user.

4 Claims, 4 Drawing Figures

TOILET HAVING WIRE-ADJUSTED WATER-SPRAY NOZZLES

BACKGROUND OF THE INVENTION

Conventional toilet provided with water-spray nozzles as disclosed in U.S. Pat. No. 4,422,190 by C. C. Huang may spray warming water towards the anus or genitals of a toilet user. However, such a water-spray nozzle is designed to have a fixed angle for water spray. Whenever washing the anus or genitals portions of a toilet user, he or she must adjust his or her pose to allow the anus or genitals portion being flushed by the spraying water, to thereby cause inconvenience or incomplete cleaning for the toilet user.

The present inventor has found the defects of conventional toilet and invented the present toilet having adjustable water-spray nozzles.

SUMMARY OF THE INVENTION

The object of the present invention is to provide a toilet having a warm water source, two valves controlling two branch conduits from the water source, a rear-side nozzle, a front-side nozzle and two spraying angle adjusters respectively adjusting the water-spraying angles of the two nozzles so that the anus or genitals of a toilet user may be thoroughly washed by optionally adjusting the water-spraying angles.

DETAILED DESCRIPTION

Figure 1:
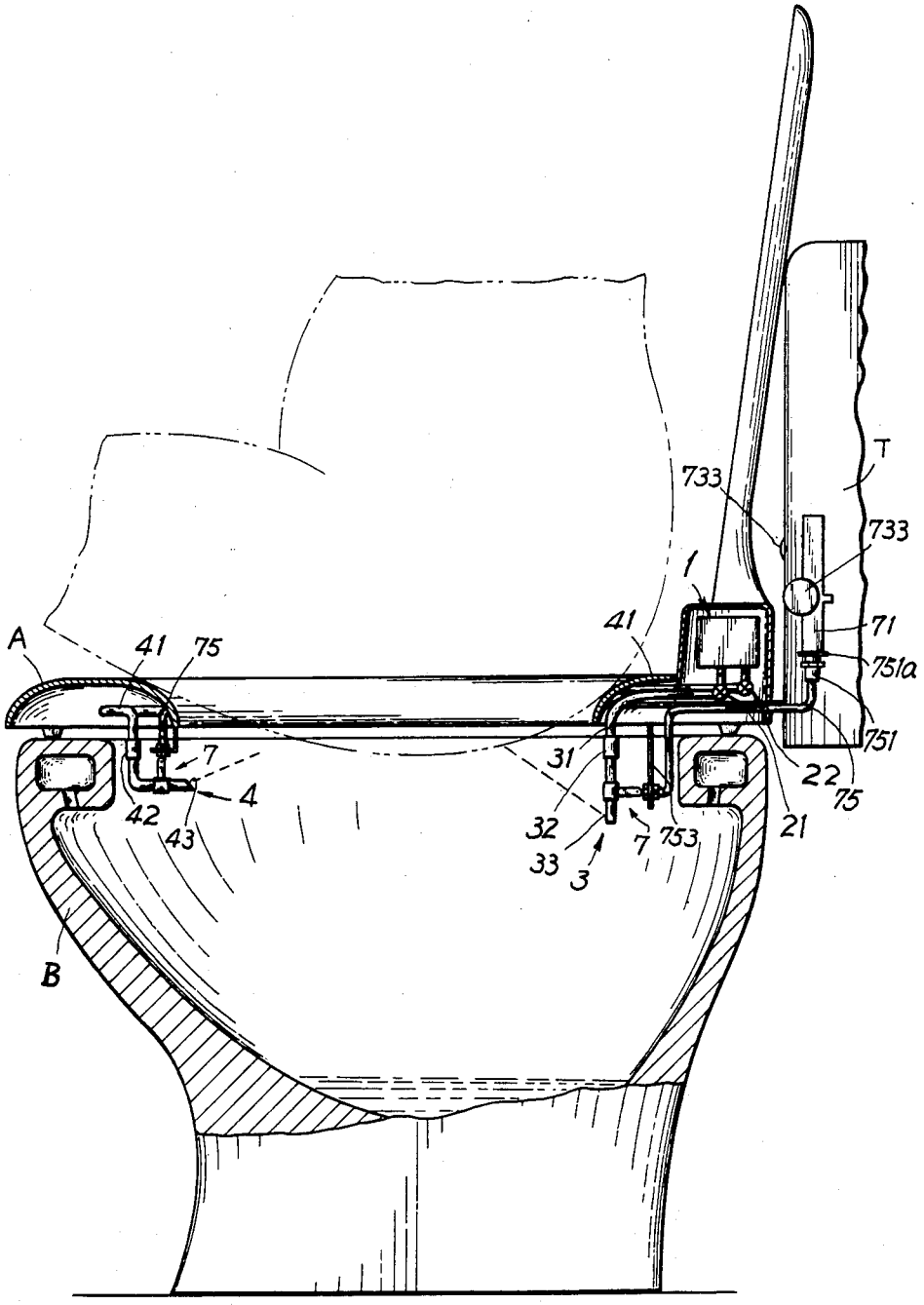
FIG. 1 is an illustration showing the application of the present invention.

As shown in the figures, the present invention comprises: a warm water source 1; two valves 21, 22 respectively controlling two branch conduits 31, 41 directing water from the source 1 to the two nozzles 3, 4; a rear-side nozzle 3 adapted for spraying human anus; a front-side nozzle 4 adapted for spraying human genitals; and two spraying-angle adjusters 7 each securing either nozzle 3 or 4 to the toilet.

The warm water source 1 is not shown in detail in the present invention, and can be easily obtained by incorporating an electric heating coil in a water reservoir and is separated into two branch water conduits 31, 41 respectively connected to the two nozzles 3, 4 as controlled by the two valves 21, 22.

Figures 2, 3, 4:
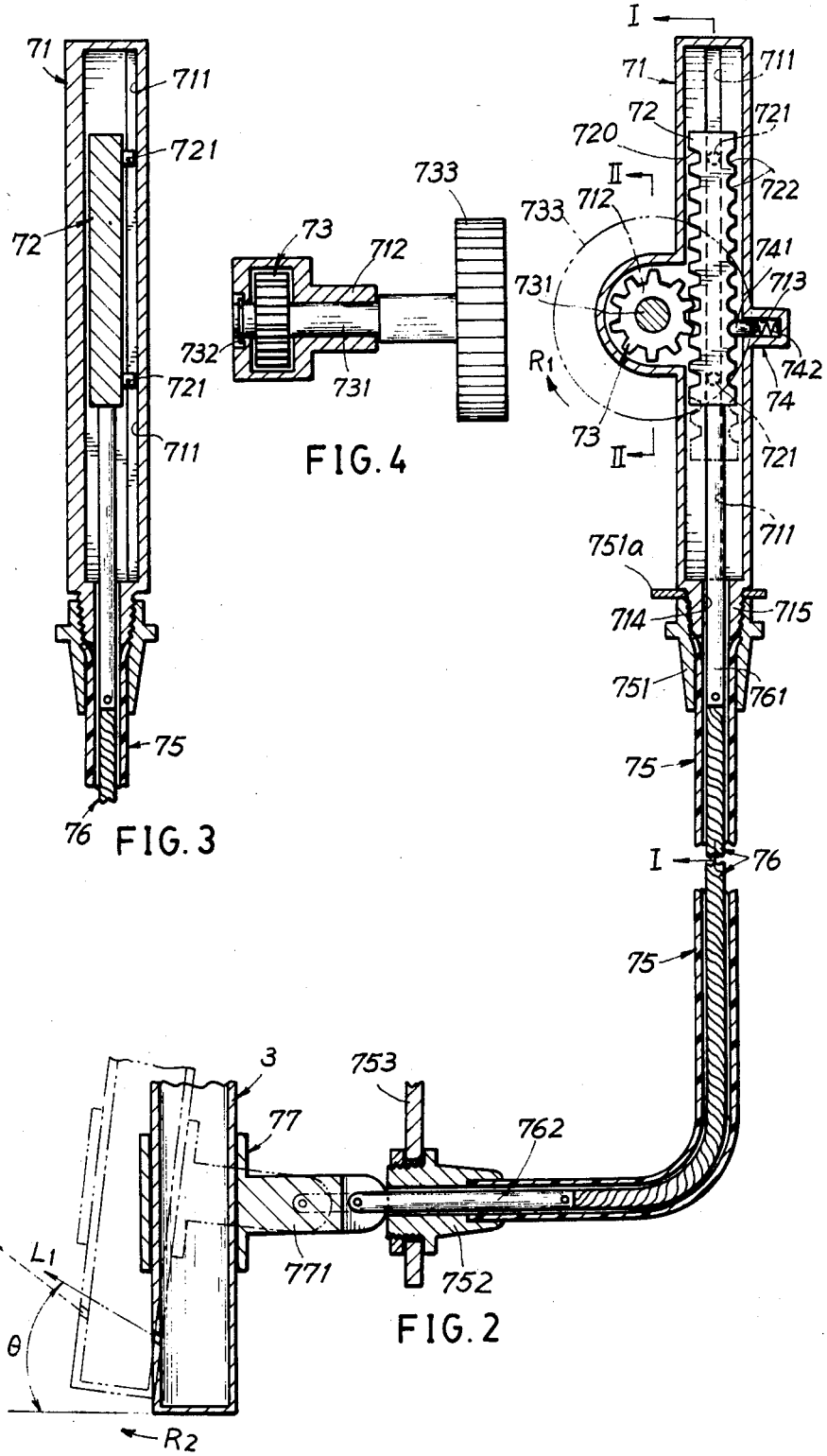
FIG. 2 is a sectional drawing of the spraying-angle adjuster of the present invention.
FIG. 3 is a sectional drawing of the present invention as viewed from II direction of FIG. 2.
FIG. 4 is a sectional drawing of the present invention as viewed from II II direction of FIG. 2.

The rear-side nozzle 3 includes a water conduit 31, a flexible portion 32 formed on the conduit 31 to serve as a fulcrum when biasing the nozzle 3 for adjusting its spraying angle and a water-spray hole 33 having a fixed spraying angle, such as $\theta$ shown in FIG. 2. The front-side nozzle 4 includes a water conduit 41, a flexible portion 42 and a water-spray hole 43.

Each of the two spraying-angle adjusters 7 includes: a longitudinal casing 71, a rack 72 reciprocatively moving in the casing 71, a driving gear 73 engaging and operating the rack 72, a positioning latch 74 temporarily braking the movement of the rack 72, a flexible hose 75 defined between the rack 72 and either nozzle 3 or 4, an actuating wire 76 reciprocatively moving in the hose 75 and a terminal collar 77 connected with the outer end of the wire 76 and also fixed with either nozzle 3 or 4.

The longitudinal casing 71 is formed with a longitudinal groove 711 for movably engaging a pair of extensions 721 of the rack 72, a sleeve 712 formed on a side portion of the casing 71 for rotatably jacketing a shaft 731 of the driving gear 73, a socket 713 on the other side portion of the casing opposite to the sleeve 712 for movably inserting a latch 741, and a male-threaded tip 715 haivng an end hole 714 inside the tip.

The rack 72 includes a plurality of rack teeth 720 formed on its one side to engage with a driving gear 73, a plurality of recesses 722 longitudinally formed on the opposite side of the teeth 720 to resiliently engage with a latch 741 of the positioning latch 74 as restored by a spring 742 retained in the socket 713, and a pair of extensions 721 protruding from the bottom of the rack 72 to slidingly engage with the groove 711 of the casing 71.

The driving gear 73 includes a shaft 731, an adjusting knob 733 fixed on one end of the shaft 731 and a retainer 732 fixed on the other end of the shaft 731 to limit the rotating movement of the gear 73 and shaft 731 within sleeve 712.

The actuating wire 76 is reciprocatively jacketed in the flexible hose 75 and includes a driving rod 761 connected between the outer end of the rack 72 and the inner end of the wire 76, and a follower rod 762 connected between the outer end of wire 76 and a lug 771 of the terminal collar 77.

The flexible hose 75 has its inner end fixed on a toilet water tank T by a bracket 751*a* and also formed with a female-threaded connector 751 to fix the male-threaded tip 715 of casing 71; and has its outer end formed as a connector 752 to fix on a toilet seat A above a toilet bowel B by a bracket 753.

The length of either rod 761 or 762 should be larger than the maximum stroke of the rack 72 or wire 76 to help stabilize the angle adjustment of either nozzle 3 or 4 when adjusting the water-spray angle of either nozzle.

When it is necessary to adjust the water-spray angle of the present invention, the adjusting knob 733 is rotated clockwise in direction R1 as shown in FIG. 2 such that the driving gear 73 will push the rack 72 downwards to forward the wire 76 to biase the nozzle 3 in direction R2 to variate the water-spray direction from the original direction L1 to the new one L2 as shown in dotted line of FIG. 2. The adjustment of nozzle 4 can be operated in a similar manner as above-mentioned.

The resilience of the spring 742 is so small that it may not resist the operation of the adjusting knob 733 by human hand. However, it may force the latch 74 to temporarily brake the movement of the rack 72 and wire 76 when releasing the knob, to thereby prevent the retraction of the rack or wire if tensioned by the back pressure of the spraying water.

I claim:

1. A toilet having a wire-adjusted water-spray nozzle comprising:

a warm water source;

two valves respectively controlling two branch water conduits directing water from said water source;

a rear-side nozzle adapted for spraying the human anus, and being fed by one said branch water conduit, a flexible portion formed on said conduit and a water-spray hole with a fixed spraying angle formed in said conduit, a front-side nozzle adapted for spraying the human genitals and being fed by the other branch water conduit, a flexible portion formed on said other conduit and a water-spray hole with a fixed spraying angle formed in said other conduit, a spraying-angle adjuster securing at least one of said nozzles on the toilet and including: a longitudinal casing, a toothed rack reciprocatively moving in said casing, a driving gear engaging and operating the teeth of said rack, said rack having, on the side opposite said teeth, a plurality of recesses, a positioning latch resiliently engaging any one recess of a plurality of recesses for temporarily braking the rack, a flexible hose extending between said rack and either said nozzle and having its one end fixed on a toilet water tank and having the outer end fixed on said toilet seat, an actuating wire reciprocatively jacketed in said hose and having its one end connected with said rack through a driving rod and having the other end connected through a follower rod to a lug of a terminal collar which is fixed to either said nozzle, whereby upon the rotation of said driving gear, said rack will be pushed or retracted to move said nozzle about said flexible portion to adjust the water-spray angle for thoroughly cleaning either human anus or genitals.

2. A toilet according to claim 1, wherein the length of either said driving rod or said follower rod of said actuating wire is larger than the maximum stroke of said rack or said wire when operating said driving gear.

3. A toilet according to claim 1, wherein said driving gear has a shaft rotatably mounted in a sleeve formed on a side portion of said longitudinal casing.

4. A toilet according to claim 1, wherein said positioning latch includes a latch resiliently engaging with a recess formed on said rack, said latch resiliently held by a spring in a socket formed on the other side portion opposite to said sleeve for mounting said driving gear.

* * * * *